US007107879B1

(12) United States Patent
Cheng

(10) Patent No.: US 7,107,879 B1
(45) Date of Patent: Sep. 19, 2006

(54) BOX WRENCH ASSEMBLY

(76) Inventor: Chin Shun Cheng, No. 22, Lane 427, Dasheng Street, Taichung City 408 (TW)

( * ) Notice: Subject to any disclaimer, the term of this patent is extended or adjusted under 35 U.S.C. 154(b) by 0 days.

(21) Appl. No.: 11/100,475

(22) Filed: Apr. 7, 2005

(51) Int. Cl.
*B25B 13/06* (2006.01)
*B25B 13/08* (2006.01)
*B25B 13/00* (2006.01)

(52) U.S. Cl. ..... 81/121.1; 81/186

(58) Field of Classification Search ..... 81/121.1, 81/186, 124.3
See application file for complete search history.

(56) References Cited

U.S. PATENT DOCUMENTS 4,646,594 A * 3/1987 Tien ..... 81/121.1
5,388,486 A * 2/1995 Ruzicka et al. ..... 81/124.3
5,832,792 A * 11/1998 Hsieh ..... 81/124.6
5,860,339 A * 1/1999 Mikic et al. ..... 81/186
6,901,824 B1 * 6/2005 Chen ..... 81/63.2
6,904,833 B1 * 6/2005 Wright ..... 81/121.1
6,962,100 B1 * 11/2005 Hsien ..... 81/186
6,997,085 B1 * 2/2006 Yamamoto ..... 81/121.1
2004/0016324 A1 * 1/2004 Wright ..... 81/121.1
2004/0020332 A1 * 2/2004 Hsieh ..... 81/186
2004/0093996 A1 * 5/2004 Fu ..... 81/121.1
2005/0061116 A1 * 3/2005 Hsien ..... 81/121.1
2005/0109166 A1 * 5/2005 Hsien ..... 81/121.1

* cited by examiner

*Primary Examiner*—David B. Thomas

(57) ABSTRACT

A box wrench assembly has latch edges and accommodating grooves sequentially disposed around the internal periphery of an operating end of a box wrench, and each accommodating groove is disposed between two latch edges, and a groove is disposed proximate to the middle of a protruded surface of the latch edge to divide a cambered surface into two, so as to fit screw pieces of different shapes when the wrench is used.

4 Claims, 18 Drawing Sheets

BOX WRENCH ASSEMBLY

BACKGROUND OF THE INVENTION

1. Field of the Invention

The present invention generally relates to a wrench assembly, and more specifically to a box wrench assembly that fits various kinds of screw pieces and provides a more convenient and faster way for the operation of the box wrench.

2. Description of the Related Art

Referring to FIG. 18, a box wrench assembly of a prior art has a polygonal groove 91 either in a dodecagonal shape or a hexagonal shape for engaging a screw piece, but such assembly has the following shortcoming:

Since screw pieces come with various different shapes including the gear, star, hexagonal and dodecagonal shapes, therefore a single polygonal groove 91 can only fit a single compatible screw piece, but not the screw pieces of various different shapes. Thus, the box wrench of this sort has poor expandability.

SUMMARY OF THE INVENTION

A primary objective of the present invention is to provide a box wrench assembly that has latch edges and accommodating grooves sequentially disposed around the internal periphery of an operating end of a box wrench, and each accommodating groove is disposed between two latch edges, and a groove is disposed proximate to the middle of a protruded surface of the latch edge to divide a cambered surface into two, so as to fit screw pieces of various different shapes when the wrench is used.

DETAILED DESCRIPTION OF THE PREFERRED EMBODIMENTS

Figure 1:
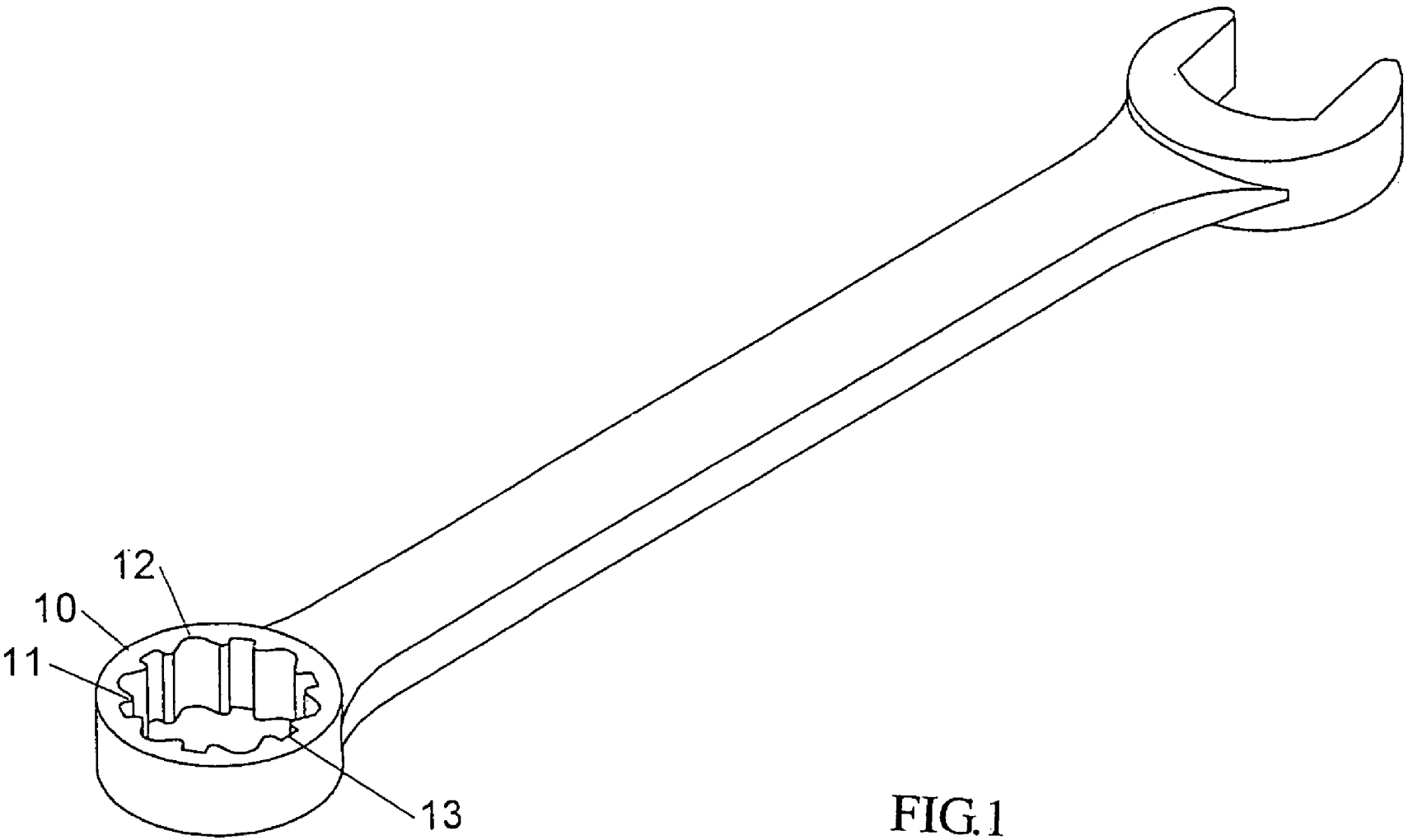
FIG. 1 is a perspective view of the invention.
Figure 2:
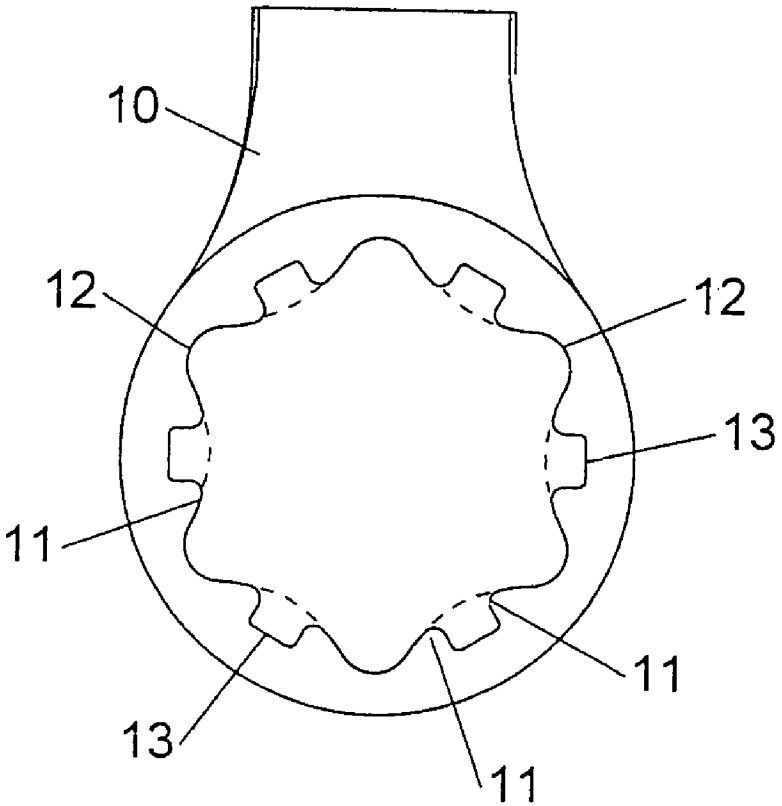
FIG. 2 is a top view of the invention.
Figure 2:
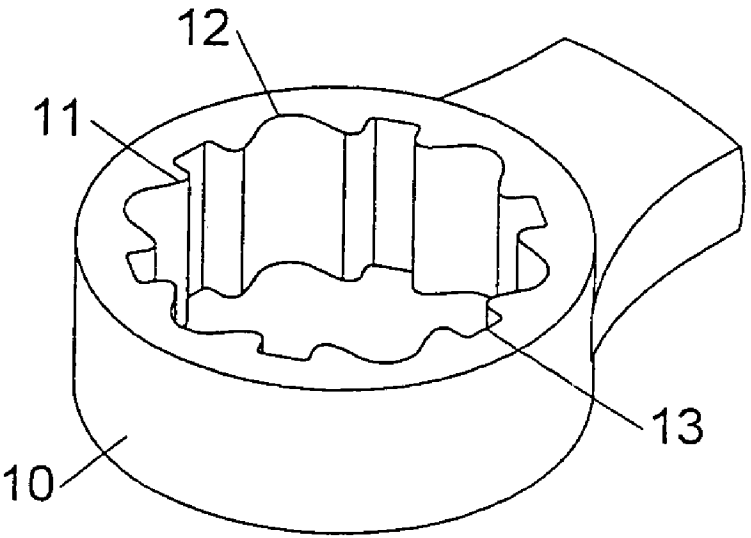

Referring to FIGS. 1 and 2, a box wrench 10 has a plurality of latch edges 11; a plurality of accommodating grooves 12 sequentially disposed around the internal periphery of an operating end of a box wrench 10, and each accommodating groove 12 is disposed between two latch edges 11; and a plurality of grooves 13, each groove 13 being disposed proximate to the middle of a protruded surface of the latch edge and having two lateral sides parallel with each other and a bottom edge substantially linear, such that a cambered surface of the latch edge 11 is divided into two.

Figure 3:
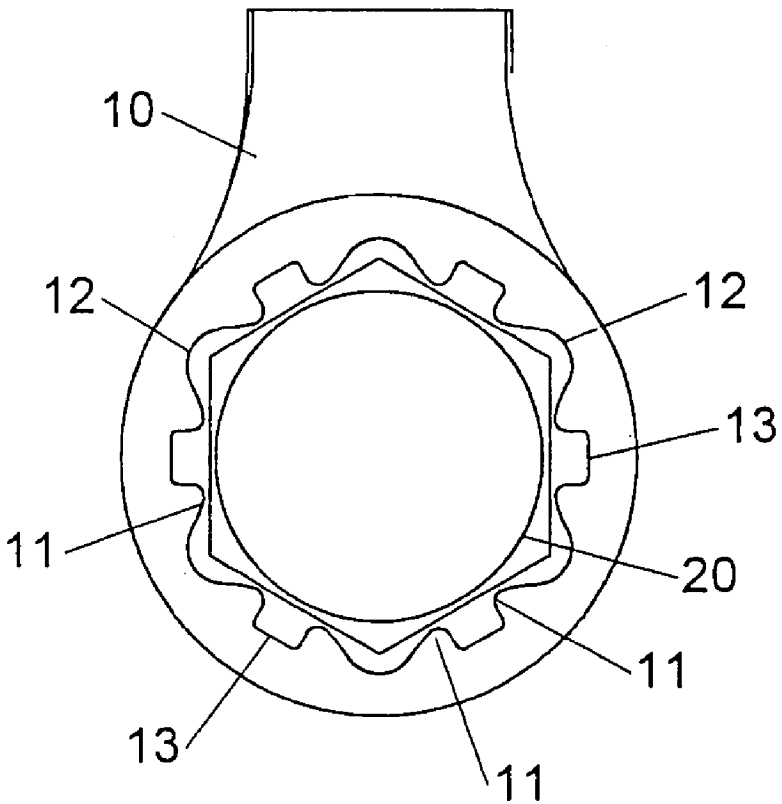
FIG. 3 is a schematic view of turning a hexagonal screw piece according to the invention.
Figure 3:
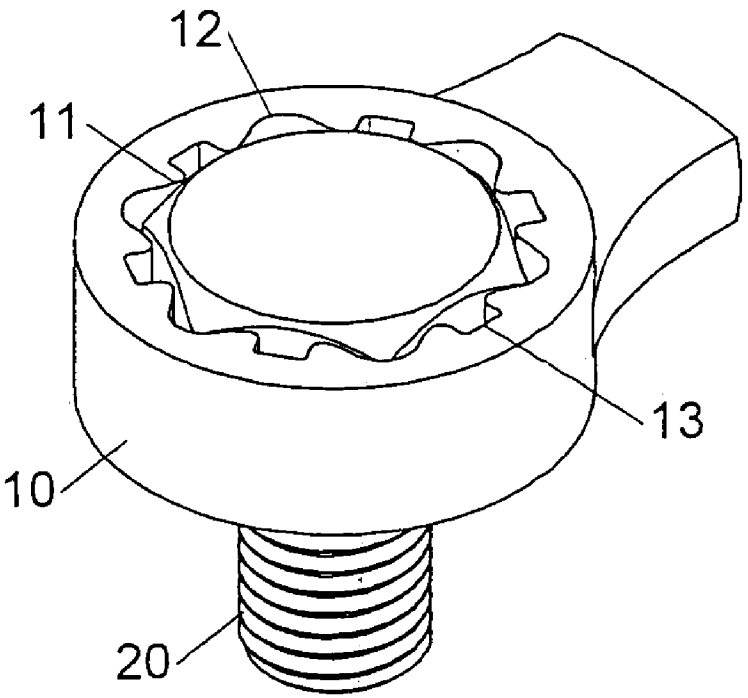

Referring to FIG. 3, the box wrench 10 engages a hexagonal screw piece 20, the latch edges 11 can hold the six edges of the hexagonal screw piece 20 in position, since the latch edges 11, accommodating grooves 12 and grooves 13 are disposed at the internal periphery of the wrench 10, and the six corners of the hexagonal screw piece 20 are accommodated in the accommodating grooves 12 of the wrench 10 for turning the screw piece 20.

Figure 4:
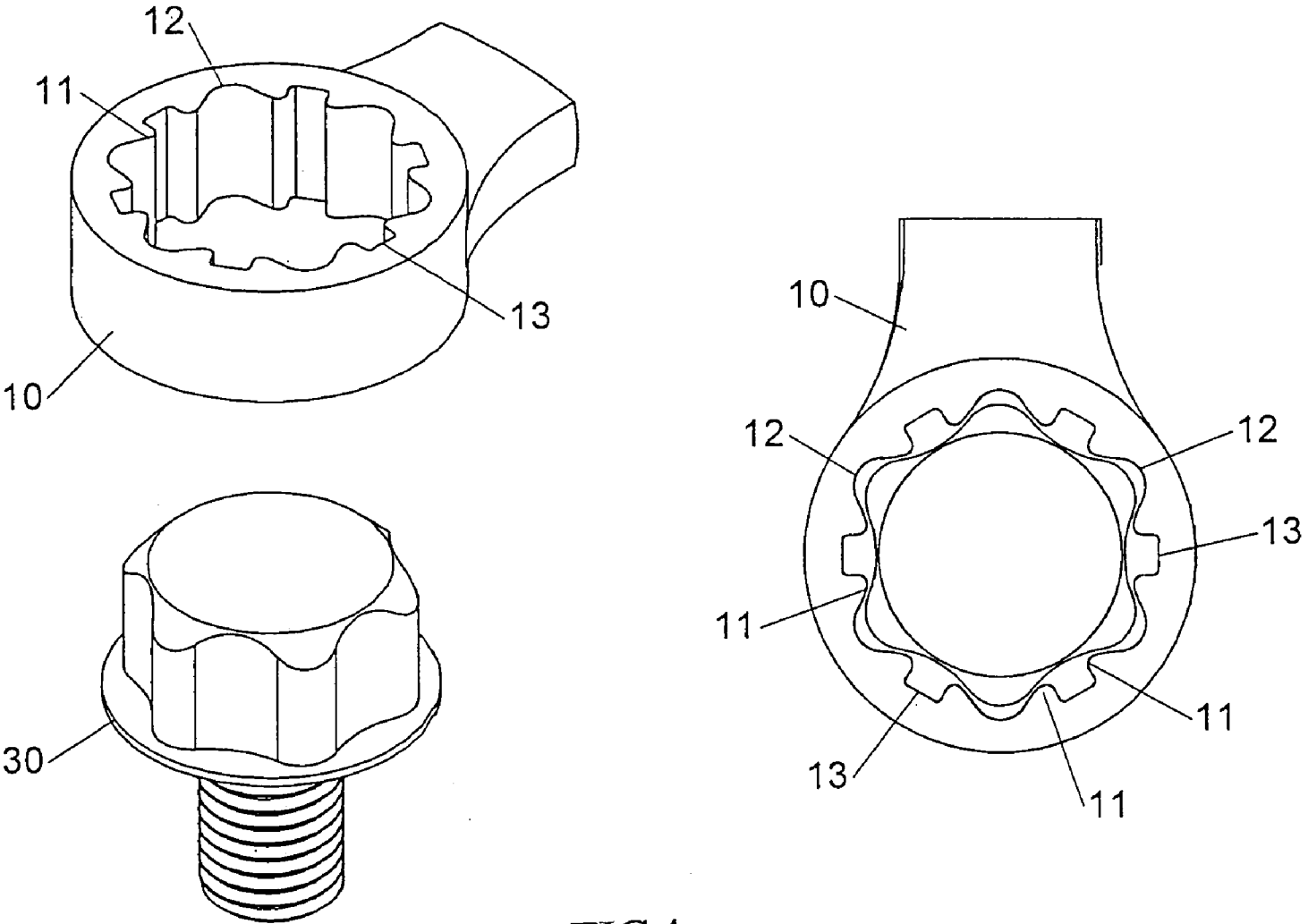
FIG. 4 is a schematic view of turning a star screw piece according to the invention.

Referring to FIG. 4, the six corners of a star screw piece are accommodated in the accommodating grooves 12 of the box wrench 10 and thus the star screw piece can be turned.

Figure 5:
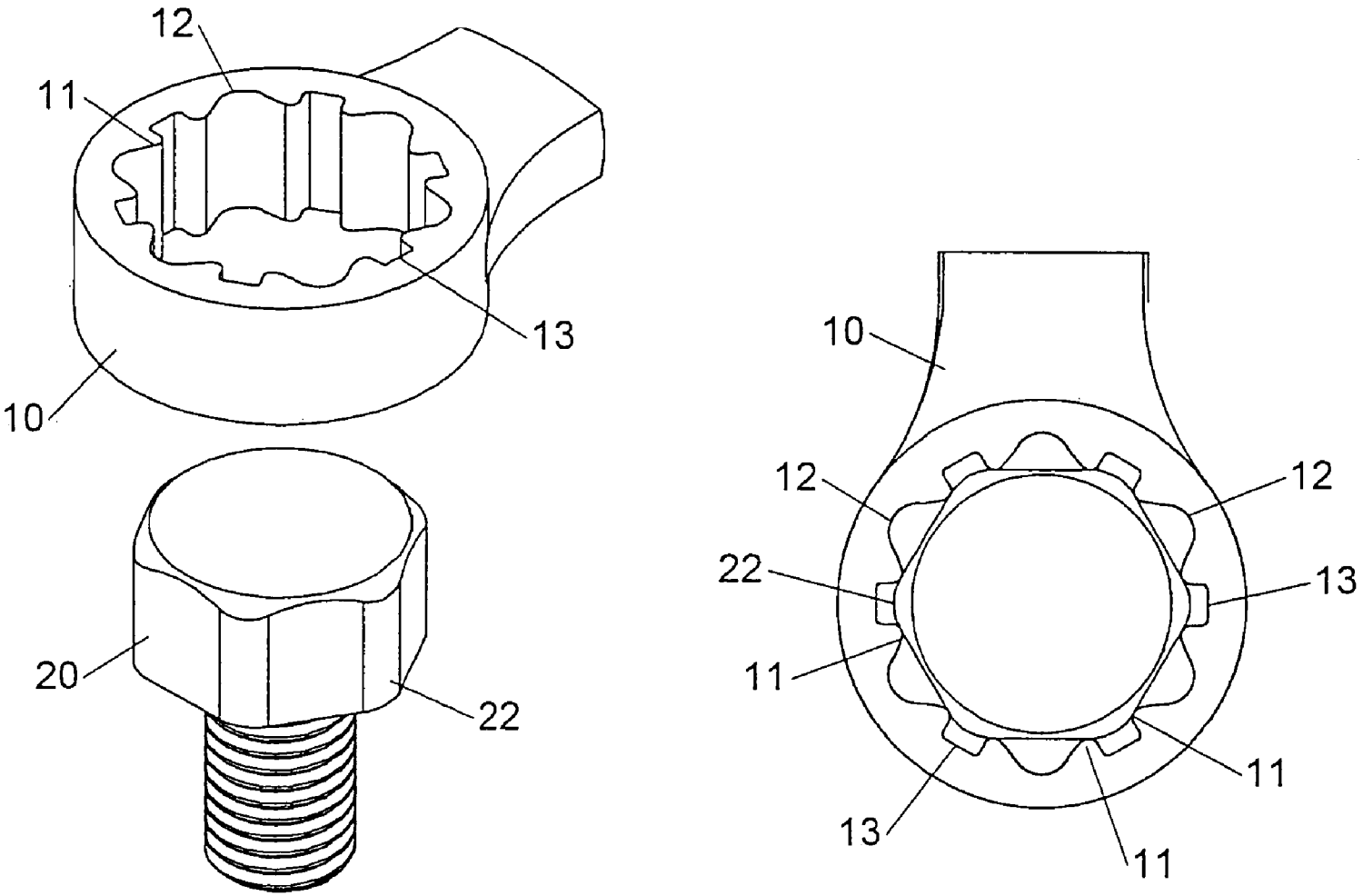
FIG. 5 is a schematic view of turning a round screw piece according to the invention.

Referring to FIG. 5, a screw piece 20 is turned frequently, and thus causing the six corners of the screw piece 20 worn out and become round corners 22. As a result, the screw piece 20 cannot be used anymore. At this time, the grooves 13 of the wrench 10 can engage the round corners of screw piece 20 to turn the screw piece 20.

Figure 6:
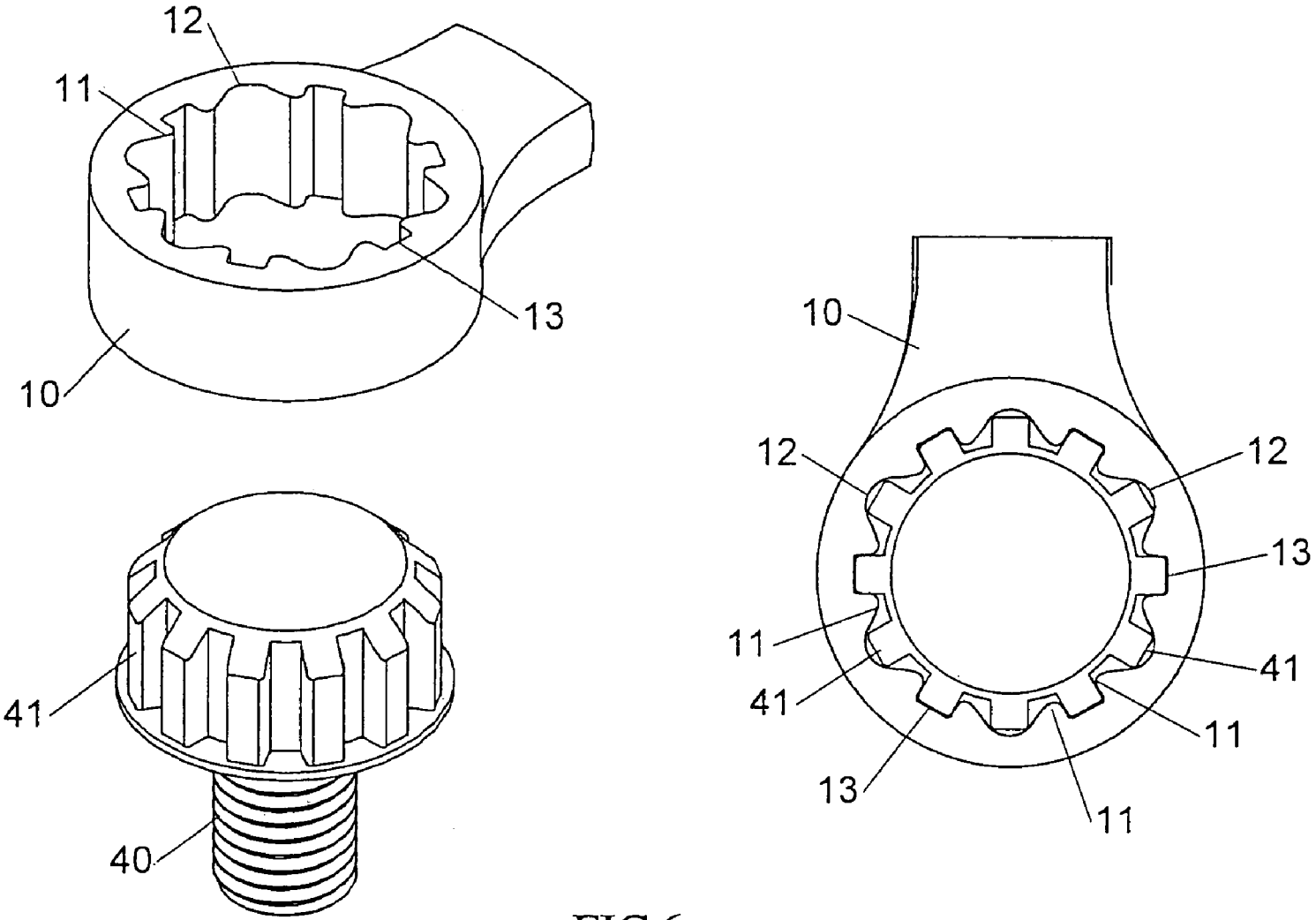
FIG. 6 is a schematic view of turning a gear screw piece according to the invention.

Referring to FIG. 6, the box wrench has latch edges 11, accommodating grooves 12 and grooves 13 at the internal periphery of the box wrench 10, and six protrusions 41 of a gear screw piece 40 are accommodated in the accommodating grooves 12 of the box wrench 10, and another six protrusions are tightly latched into the grooves 13, so as to turn the gear screw piece 40.

Figure 7:
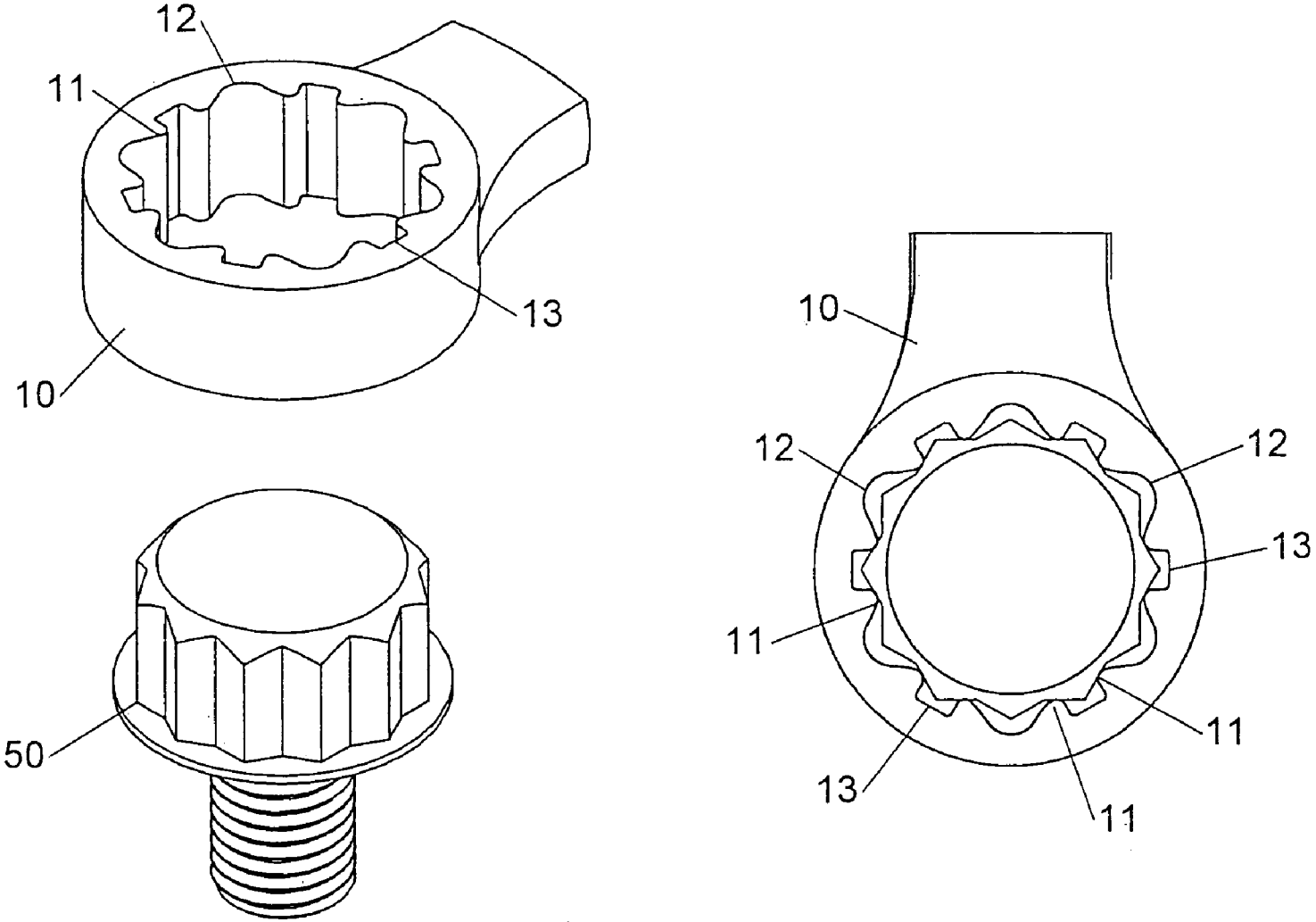
FIG. 7 is a schematic view of turning a dodecagonal screw piece according to the invention.

Referring to FIG. 7, the box wrench has latch edges 11, accommodating grooves 12 and grooves 13 at the internal periphery of the box wrench 10, and thus the latch edges 11 hold the twelve edges of a dodecagonal screw piece 50 in position, and six corners of the dodecagonal screw piece 50 are accommodated in the accommodating grooves 12 and another six corners are accommodated in the grooves 13, so as to turn the dodecagonal screw piece 50.

Figure 8:
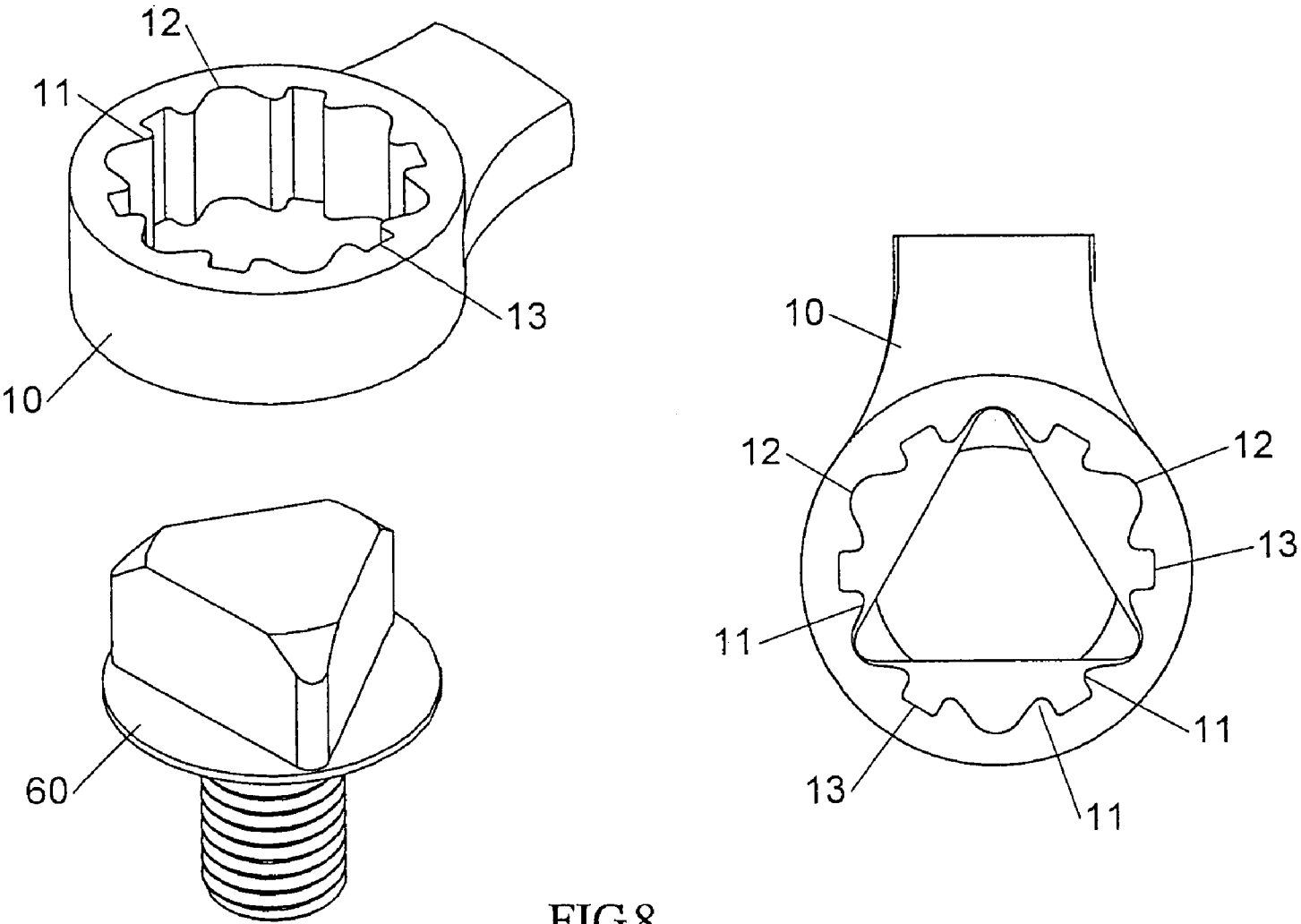
FIG. 8 is a schematic view of turning a triangular screw piece according to the invention.

Referring to FIG. 8, three corners of a triangular screw piece 60 are accommodated in the accommodating grooves 12 to turn the triangular screw piece 60.

Figure 9:
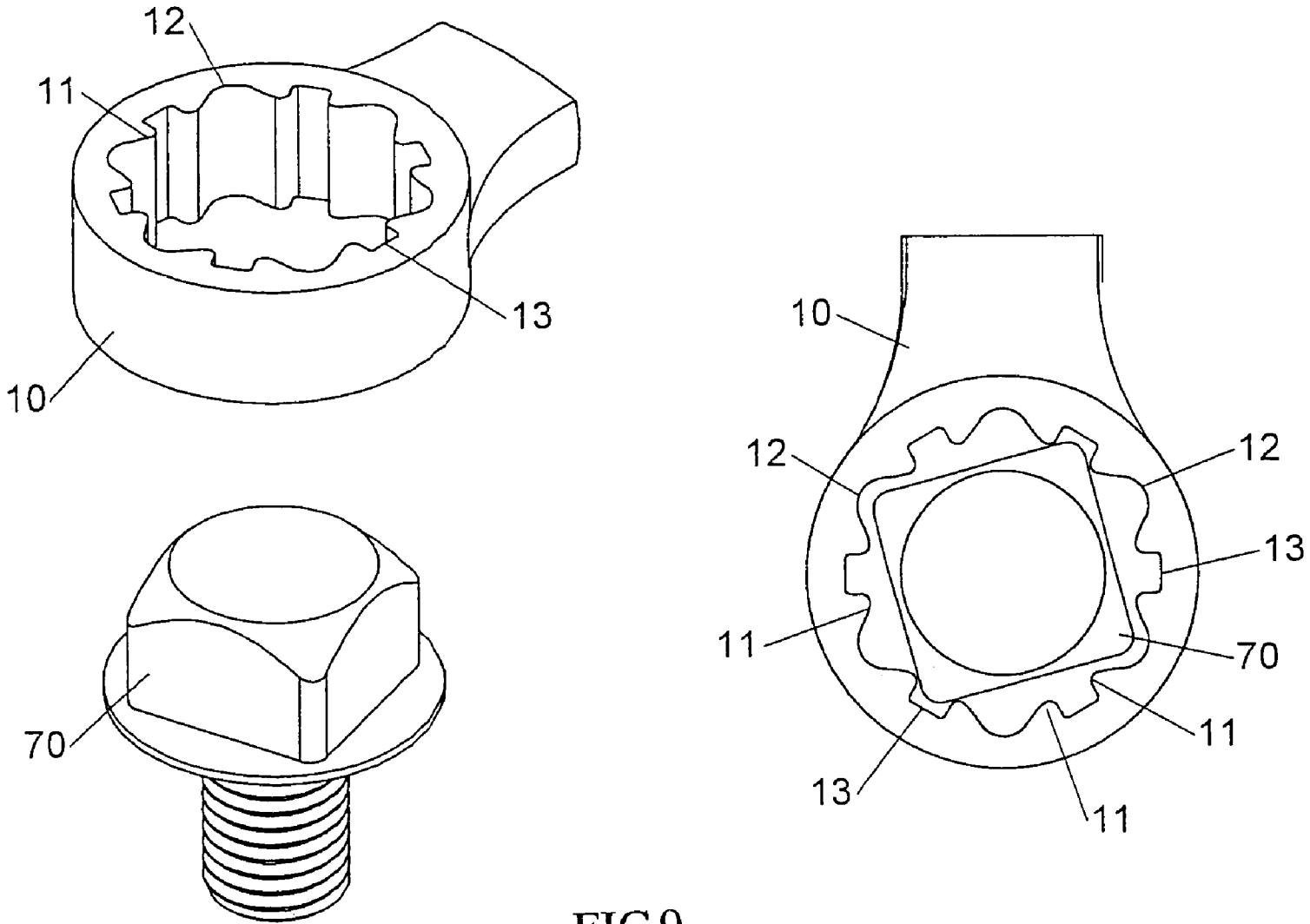
FIG. 9 is a schematic view of turning a tetrahedral screw piece according to the invention.

Referring to FIG. 9, two comers of a tetragonal screw piece 70 are accommodated in the grooves 13 to turn the tetragonal screw piece 70.

Figure 10:
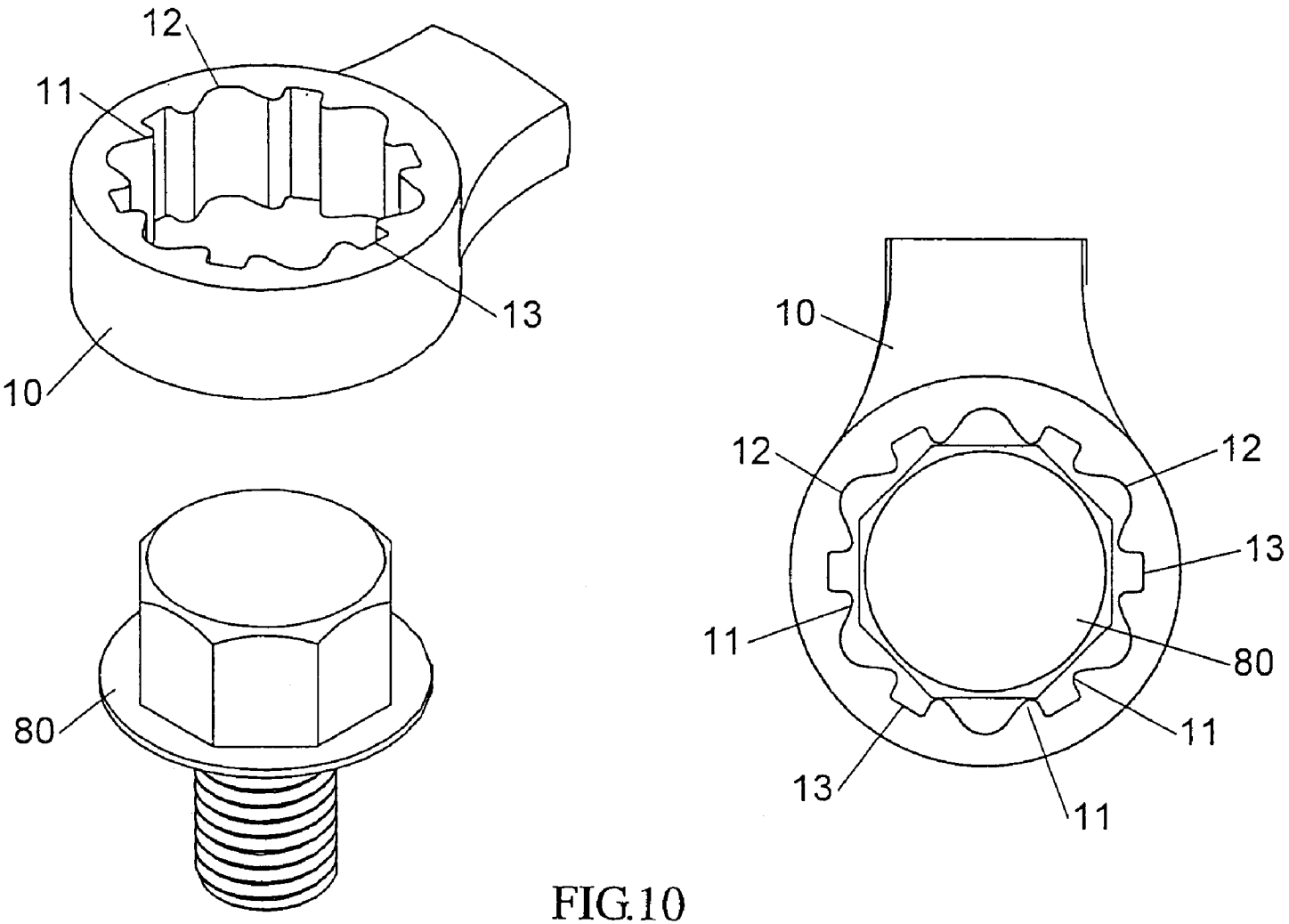
FIG. 10 is a schematic view of turning an octagonal screw piece according to the invention.

Referring to FIG. 10, the eight sides of an octagonal screw piece 80 are latched by the latch edges 11 to turn the octagonal screw piece 80.

Figure 11:
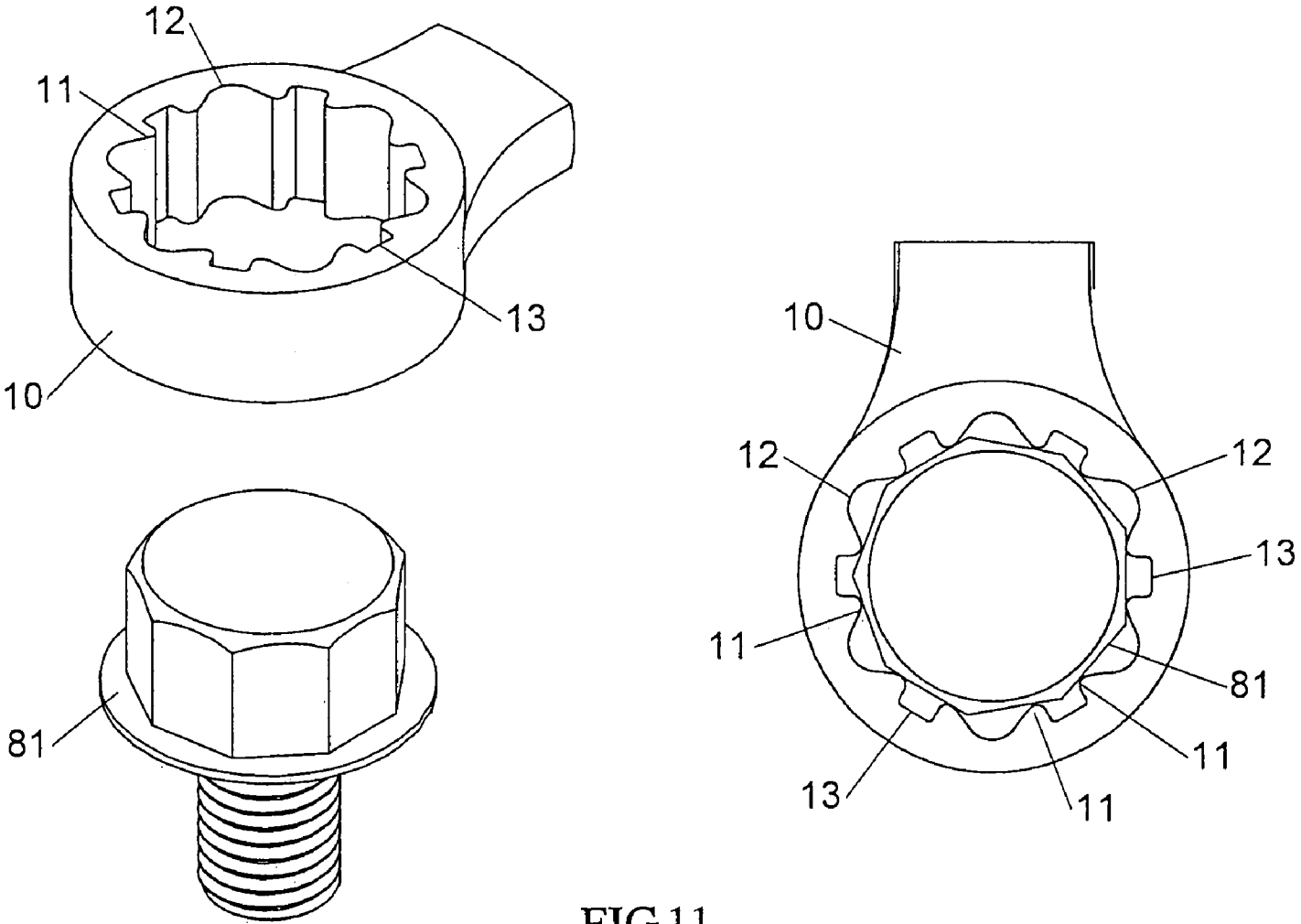
FIG. 11 is a schematic view of turning an enneahedral screw piece according to the invention.

Referring to FIG. 11, the nine sides of an enneahedral screw piece 81 are latched by the latch edges 11 to turn the enneahedral screw piece 81.

Figure 12:
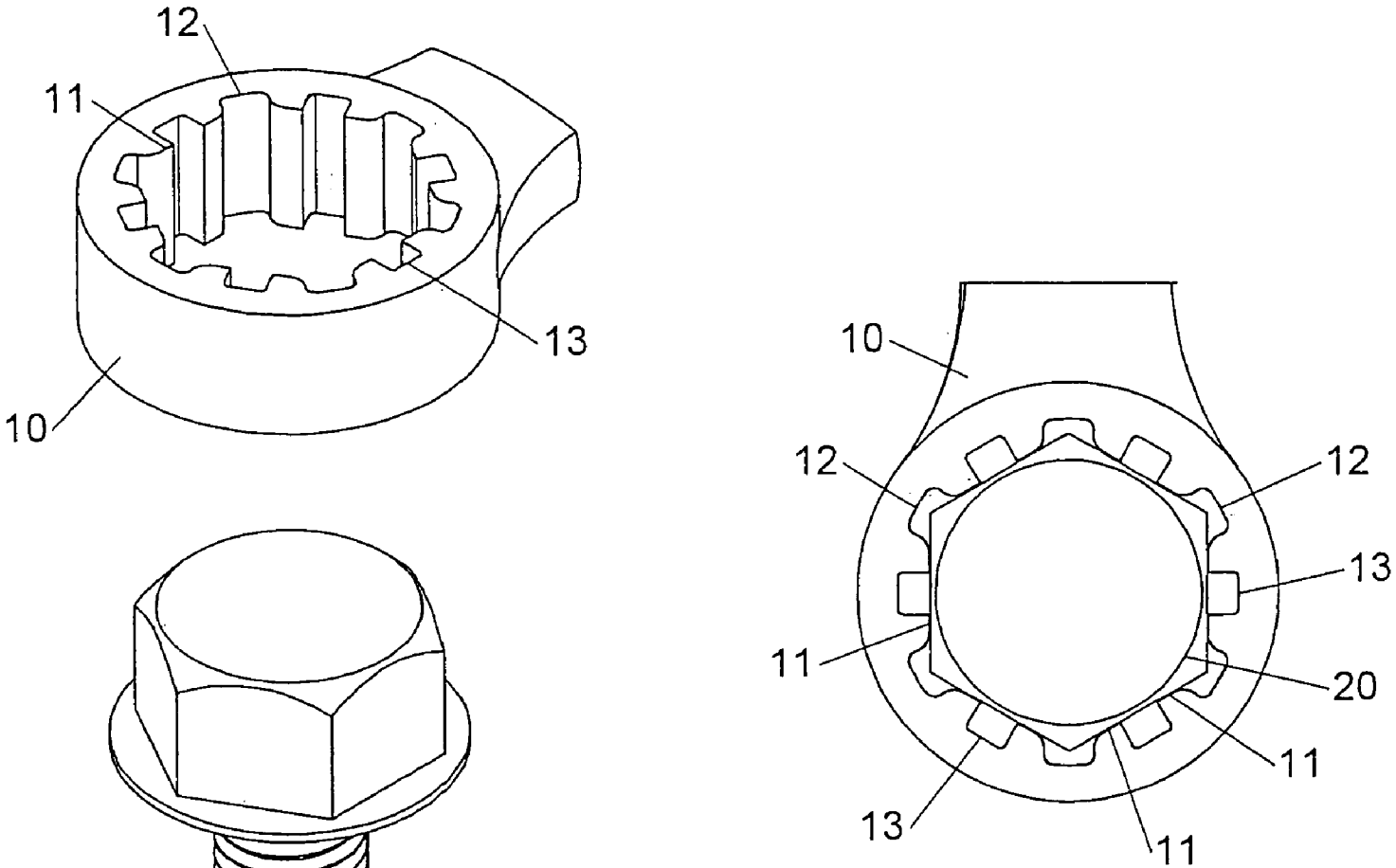
FIG. 12 is a schematic view of a second preferred embodiment of the invention.

Referring to FIG. 12 for a second preferred embodiment, the latch edge 11 at the internal surface of the box wrench 10 is a protruded cambered surface, which is comprised of two curved lines or a plurality of curved lines, and a groove 13 is disposed proximate to the middle of the latch edge 11 of the box wrench 10. The included angle of two lateral sides of the groove 13 is larger than or smaller than 90 degrees, and the bottom edge of the groove 13 is substantially curved, such that the cambered surface of the latch edge 11 is divided into two. As a result, a screw piece 20, a star screw piece 30, a gear screw piece 40, or a dodecagonal screw piece 50 can be turned by the box wrench 10.

Figure 13:
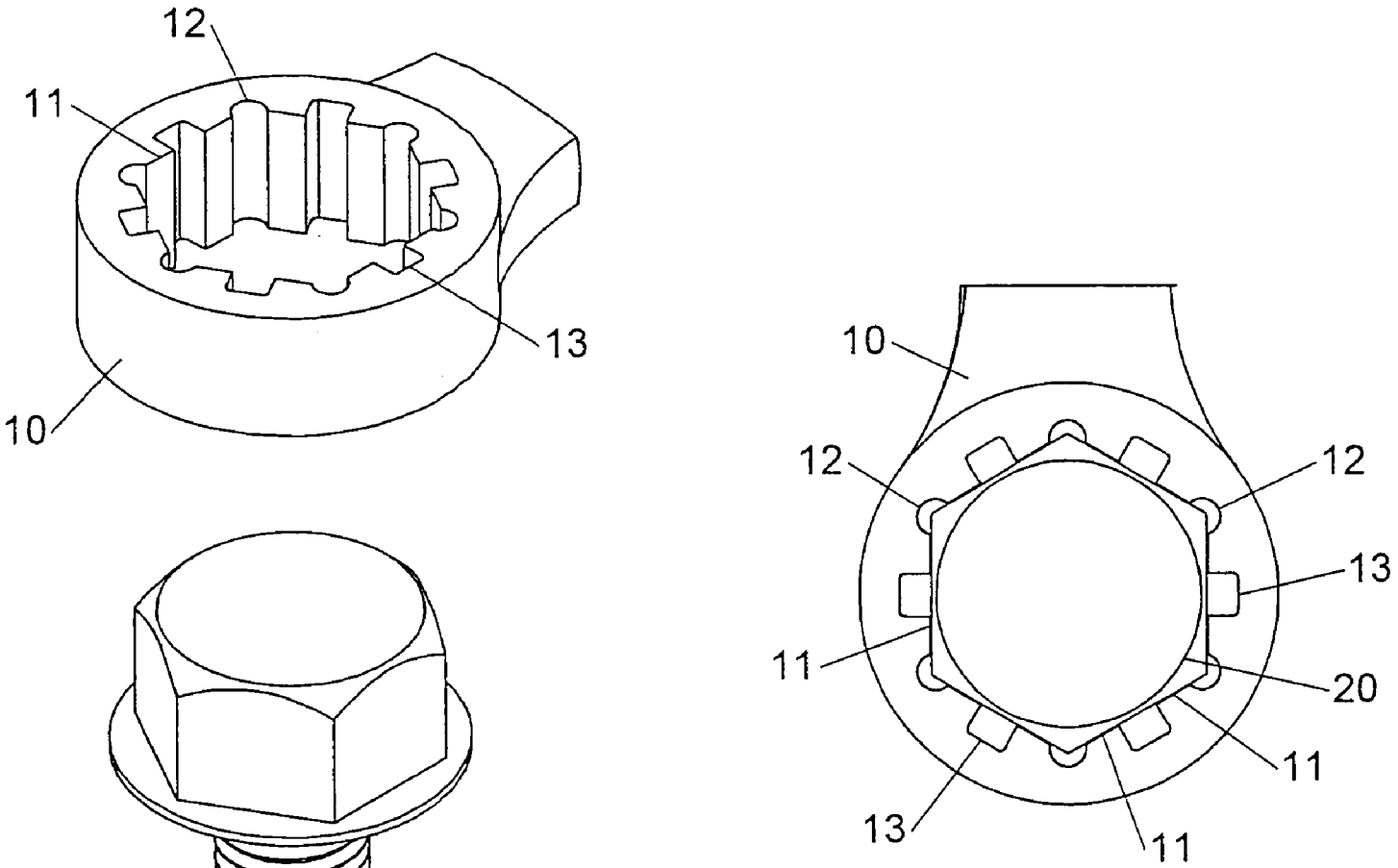
FIG. 13 is a schematic view of a third preferred embodiment of the invention.

Referring to FIG. 13 for a third preferred embodiment, the latch edge 11 of the box wrench 10 is linear, and the six corners of a screw piece 20 are accommodated in the accommodating grooves 12 of the box wrench 10, and the latch edges 11 can latch the sides of the screw piece 20.

Figure 14:
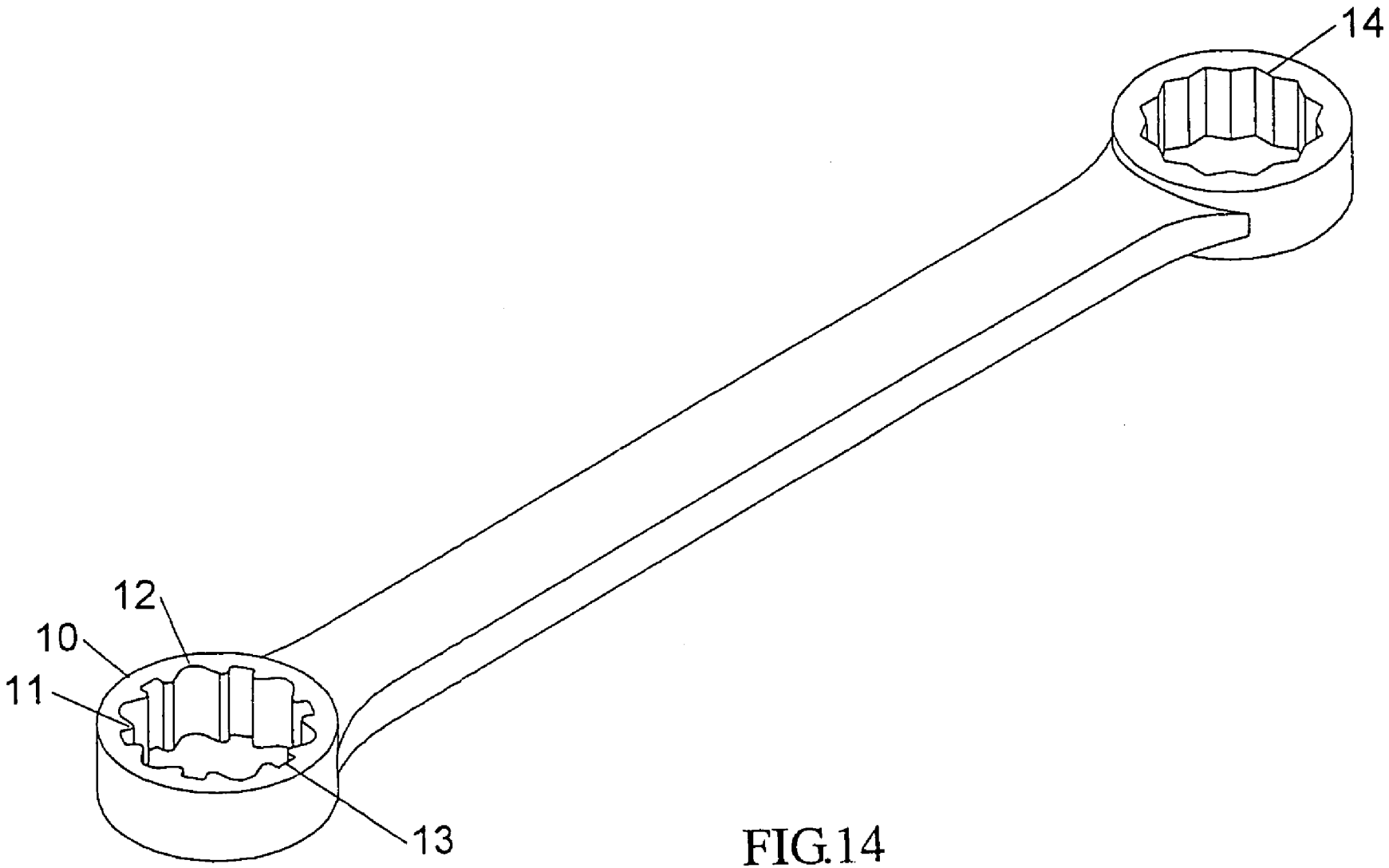
FIG. 14 is a perspective view of another model of the invention.

Referring to FIG. 14 for another model of a box wrench according to a preferred embodiment of the present invention, the box wrench 10 has a polygonal groove 14 on the other tip of the wrench, and thus such wrench is an assembly having the advantages of both the invention and the prior art.

Figure 15:
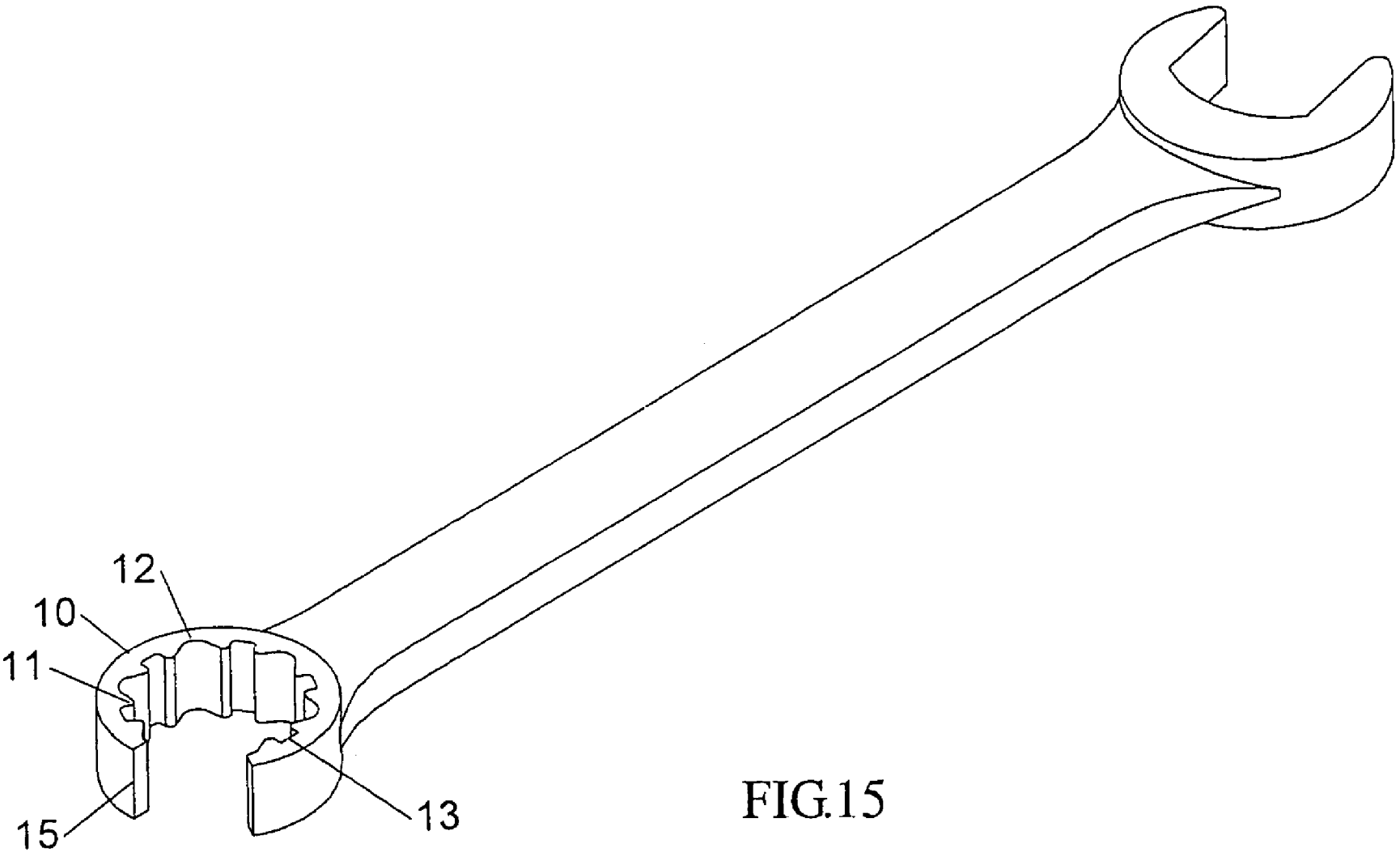
FIG. 15 is a perspective view of an open box wrench of the invention.

Referring to FIG. 15, an opening 15 is disposed at an appropriate position of the wrench to define an open box wrench model.

Figure 16:
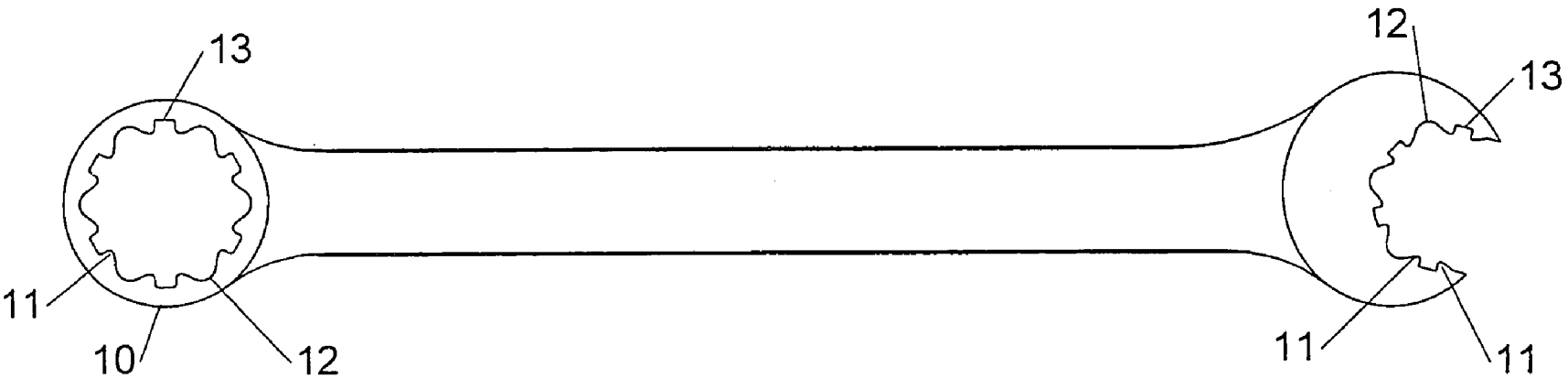
FIG. 16 is a schematic view of a preferred embodiment of the invention.
Figure 17:
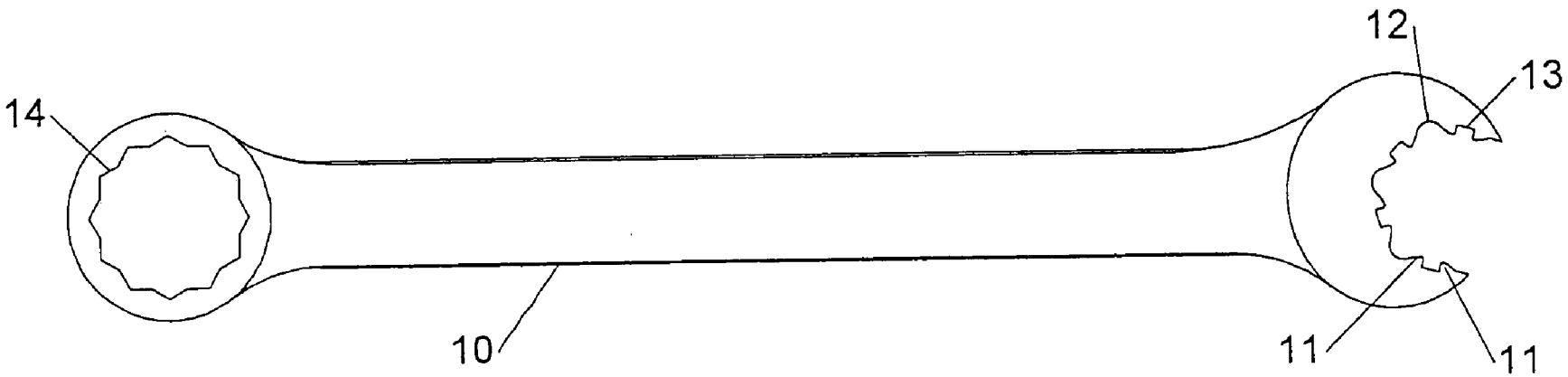
FIG. 17 is a schematic view of another preferred embodiment of the invention.
Figure 18:
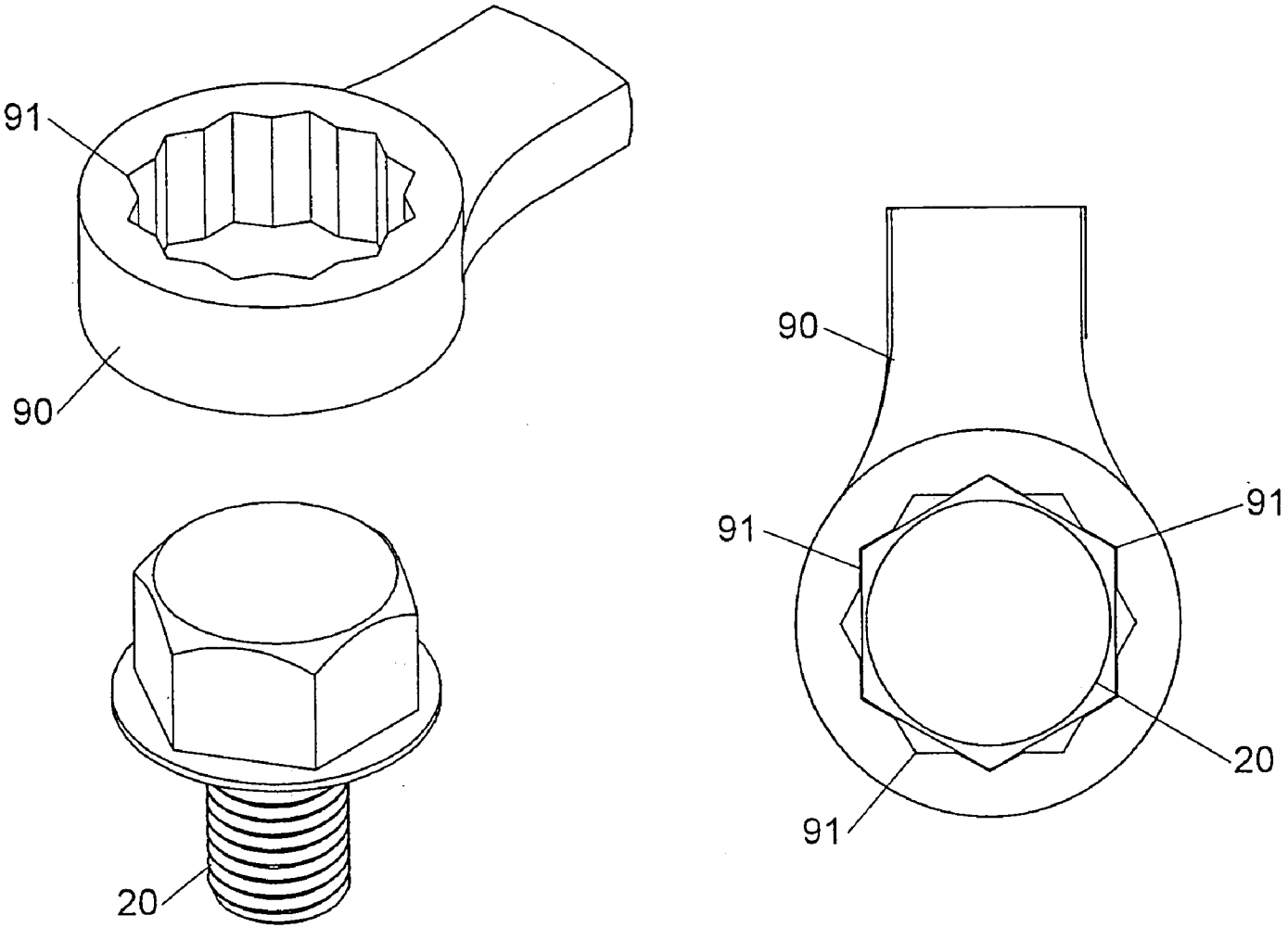
FIG.18 PRIOR ART
FIG. 18 is a schematic view of a box wrench of a prior art.

Referring to FIGS. 16 and 17, an open wrench has latch edges 11, accommodating grooves 12 and grooves 13 at the four sides, and such wrench has the same effects of the present invention.

The main advantages of the present invention are as follows:

1. Referring to FIG. 2, a box wrench 10 assembly comes with radii of large and small curvatures. The latch edges 11 have a radius of large curvature, the accommodating grooves 12 have a radius of small curvature, and the grooves have a radius of large curvature, such that the box wrench 10 has latch edges 11, accommodating grooves 12 and grooves sequentially disposed around the internal surface of the box wrench 10. With the design of grooves 13, the box wrench 10 can fit screw pieces of various different shapes.

2. The latch edges 11, accommodating grooves 12 and grooves 13 are sequentially disposed around the internal periphery of an operating end of the box wrench 10, and the latch edges 11 could be curved or linear or constituted of two curved lines, so that the box wrench 10 can engage a hexagonal, tetragonal, star, round, gear, or dodecagonal screw piece.

What is claimed is:

1. A box wrench assembly, comprising:

a plurality of latch edges, disposed around an internal periphery of an operating end of a wrench, wherein each of said latch edges comprises a protruded surface;

a plurality of accommodating grooves, disposed sequentially with said latch edges, each accommodating groove being disposed between two of said latch edges; and a groove defined in said protruded surface of each of said latch edges, wherein said groove comprises two lateral sides parallel with each other for firmly contacting two lateral sides of a square tooth of a fastener and for pinching two adjacent sides of an angle of a fastener.

2. The box wrench assembly of claim 1, wherein said groove has a bottom edge substantially linear or curved.

3. The box wrench assembly of claim 1, wherein said latch edges of said wrench are linear.

4. The box wrench assembly of claim 1, wherein said wrench has an opening to define an open box wrench model.

* * * * *